US011828423B2

(12) United States Patent
Wang et al.

(10) Patent No.: US 11,828,423 B2
(45) Date of Patent: Nov. 28, 2023

(54) LIGHT BULB APPARATUS

(71) Applicant: LEEDARSON LIGHTING CO., LTD, Fujian (CN)

(72) Inventors: Chunhua Wang, Fujian (CN); Liangliang Cao, Fujian (CN); Hongkui Jiang, Fujian (CN); Juncheng Che, Fujian (CN); Yanzeng Gao, Fujian (CN)

(73) Assignee: LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/525,263

(22) Filed: Nov. 12, 2021

(65) Prior Publication Data

US 2022/0146055 A1 May 12, 2022

(30) Foreign Application Priority Data

| | | |
|---|---|---|
| Nov. 12, 2020 | (CN) | 202022613488.9 |
| Nov. 12, 2020 | (CN) | 202022614455.6 |
| Jan. 28, 2021 | (CN) | 202120247999.5 |

(51) Int. Cl.

| | |
|---|---|
| ***F21K 9/237*** | (2016.01) |
| ***F21K 9/232*** | (2016.01) |
| *F21Y 107/30* | (2016.01) |
| *F21V 19/00* | (2006.01) |
| *F21Y 103/00* | (2016.01) |
| *F21Y 115/15* | (2016.01) |

(52) U.S. Cl.

CPC ..... *F21K 9/232* (2016.08); *F21K 9/237* (2016.08); *F21V 19/003* (2013.01); *F21Y 2103/00* (2013.01); *F21Y 2107/30* (2016.08); *F21Y 2115/15* (2016.08)

(58) Field of Classification Search

CPC ..... F21K 9/232; F21K 9/237; F21K 9/238; F21Y 2103/00; F21Y 2107/30; F21Y 2115/15; F21Y 2107/70; F21V 19/003; F21V 19/0025; F21V 19/002; F21S 4/22

See application file for complete search history.

(56) References Cited

U.S. PATENT DOCUMENTS

| | | | | |
|---|---|---|---|---|
| 10,563,824 | B2 * | 2/2020 | Yeung | H01L 33/48 |
| 2017/0084809 | A1 * | 3/2017 | Jiang | H01L 33/56 |
| 2019/0032861 | A1 * | 1/2019 | Li | F21K 9/237 |
| 2019/0126060 | A1 * | 5/2019 | Dijkstra | F21V 33/0004 |
| 2020/0182413 | A1 * | 6/2020 | Jiang | H05B 45/20 |

* cited by examiner

*Primary Examiner* — Omar Rojas Cadima

(74) *Attorney, Agent, or Firm* — Chun-Ming Shih; LANWAY IPR SERVICES

(57) ABSTRACT

A light bulb apparatus includes a bracket, a flexible light strip, a bulb shell, a central base and a driver. The bracket includes a central bar and multiple top hooks. The multiple top hooks have first ends connected to the central bar. The flexible light strip has multiple first bending points fixed to second ends of the multiple top hooks for expanding the flexible light strip. a bulb shell. A driver for converting an external power source to a driving current. The central base encloses a part of two wires. The central base exposes first electrodes of the two wires for connecting to the flexible light strip. The central base exposes second electrodes of the two wires for receiving the driving current. The central base and the bulb shell form a closed space for holding the flexible light strip and the bracket.

14 Claims, 11 Drawing Sheets

LIGHT BULB APPARATUS

FIELD

The present invention is related to a light bulb apparatus, and more particularly related to a light apparatus with a flexible light strip.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

In addition to provide illumination, people sometimes expect light devices to have decoration effect.

For example, light bulbs are still widely used even LED technologies are used for manufacturing light bulbs. People hope to see light strips emitting lights for decoration effect.

Therefore, it is important to figure out various new designs to achieve such goal while keeping the manufacturing cost as low as possible.

It is beneficial to design a novel light bulb device for satisfying multiple design needs.

SUMMARY

In some embodiments, a light bulb apparatus includes a bracket, a flexible light strip, a bulb shell, a central base and a driver.

The bracket includes a central bar and multiple top hooks.

The multiple top hooks have first ends connected to the central bar.

The flexible light strip has multiple first bending points fixed to second ends of the multiple top hooks for expanding the flexible light strip.

The driver converts an external power source to a driving current.

The central base encloses a part of two wires.

The central base exposes first electrodes of the two wires for connecting to the flexible light strip.

The central base exposes second electrodes of the two wires for receiving the driving current.

The central base and the bulb shell form a closed space for holding the flexible light strip and the bracket.

The driver supplies a driving current to the two electrodes.

In some embodiments, the central base is made of glass material.

In some embodiments, a heat dissipation gas is filled in the closed space via the central base.

In some embodiments, the first electrodes each has a hook structure.

The flexible light strip has end electrodes on two opposite ends.

The end electrodes each has a hole for the hook structure to insert to form an electric connection.

In some embodiments, the central bar is made of glass material.

In some embodiments, the flexible light strip is twisted as a spring.

In some embodiments, the top hook are made of elastic metal material.

In some embodiments, an antenna is attached to the flexible light strip for transmitting a wireless signal to the driver.

In some embodiments, the flexible light strip is easier to deform on the bending points.

In some embodiments, the light bulb apparatus may also include bottom hooks for fixing second bending points of the flexible light strip.

In some embodiments, the multiple top hooks and the multiple bottom hooks are misaligned along the central bar.

In some embodiments, the multiple top hooks are fixed to a top ring for the central bar to insert.

In some embodiments, the second ends of the multiple top hooks are closed hook rings for inserting the flexible light strip.

In some embodiments, the top ring is placed to a bottom position of the central bar for inserting the flexible light strip before moving to a top position of the central bar.

In some embodiments, the central bar has a buckle structure for fixing the top ring to the top position of the central bar.

In some embodiments, the multiple top hooks are fixed to a hat for attaching to a top of the central bar.

In some embodiments, the bottom hooks are partly embedded in the central base.

In some embodiments, the multiple top hooks have top hook openings for inserting the first bending points of the flexible light strip.

The multiple bottom hooks have bottom hook openings for inserting the second bending points of the flexible light strip.

The top openings and the bottom openings face to opposite directions.

In some embodiments, the central base is mounted with an auxiliary light source to emit a second light.

In some embodiments, the flexible light strip are mounted with multiple LED modules on two sides of a substrate.

DETAILED DESCRIPTION

Figure 8:
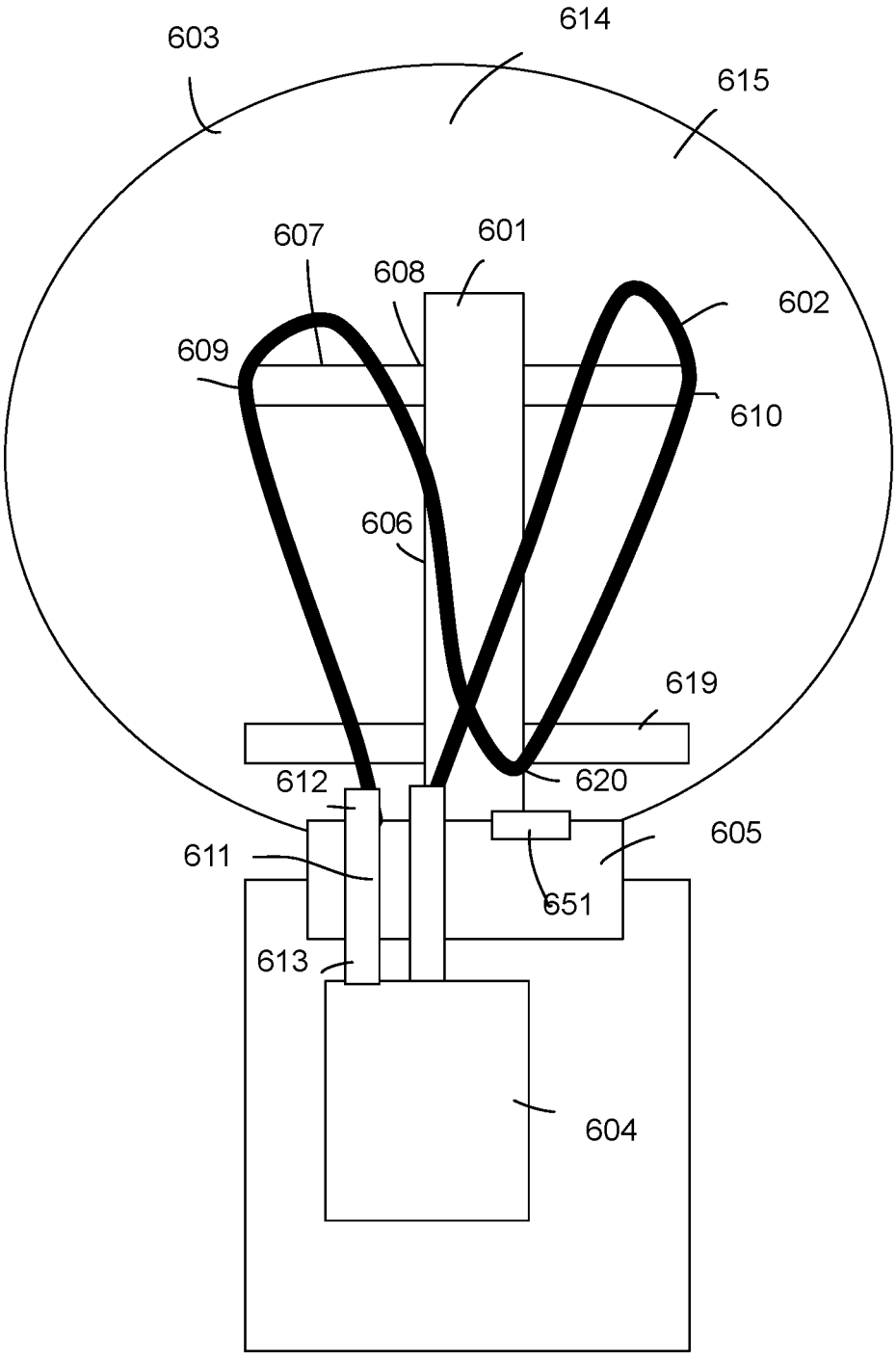
FIG. 8 illustrates another light bulb embodiment.

Please refer to FIG. 8. In FIG. 8, a light bulb apparatus includes a bracket 601, a flexible light strip 602, a bulb shell 603, a central base 605 and a driver 604.

The bracket 601 includes a central bar 606 and multiple top hooks 607.

The multiple top hooks 607 have first ends 608 connected to the central bar 601.

The flexible light strip 602 has multiple first bending points 610 fixed to second ends 609 of the multiple top hooks 607 for expanding the flexible light strip 602.

The driver 604 converts an external power source to a driving current. For example, an AC power of 110V is connected to an Edison cap for transmitting electricity to the driver 604. The driver 604 may have a rectifier, a filter, a transformer, a current source, a controller, and/or even a wireless circuit for receiving an external command.

The central base 605 encloses a part of two wires 611.

The central base 605 exposes first electrodes 612 of the two wires 611 for connecting to the flexible light strip 602.

The central base 605 exposes second electrodes 613 of the two wires 611 for receiving the driving current.

The central base 605 and the bulb shell 603 form a closed space 614 for holding the flexible light strip 602 and the bracket 601.

The driver 604 supplies a driving current to the second electrodes 613.

In some embodiments, the central base 605 is made of glass material. The bulb shell 603 is made of glass material too. The bulb shell 603 and the central base 605 in such case may be connected with heating for the glass material to melt and connect together forming the closed space 614.

In some embodiments, a heat dissipation gas 615 is filled in the closed space via the central base. The heat dissipation 615 may be added with protection gas, e.g. 10% or less of the heat dissipation gas 615 may be oxygen for increasing a life span of the flexible light strip.

In some embodiments, the first electrodes 612 each has a hook structure. For example, the bottom hooks 51 in FIG. 3 may be used for connecting to the driver for receiving the driving current.

Figure 9:
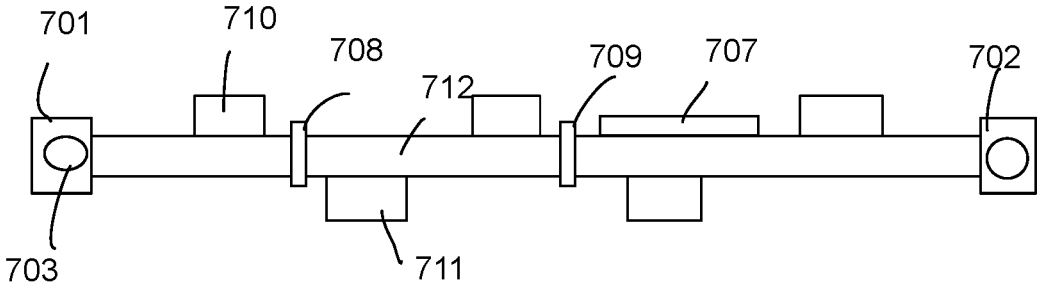
FIG. 9 illustrates a flexible light strip example.

Please see FIG. 9. The flexible light strip has end electrodes 701, 702 on two opposite ends.

The end electrodes 701, 702 each has a hole 703 for the hook structure to insert to form an electric connection. In other words, during assembly, the hook structure of the bottom hook may insert into the holes 703 of the end electrodes 701, 702 of the flexible light strip.

In FIG. 8, the central bar 606 is made of glass material.

Figure 11:
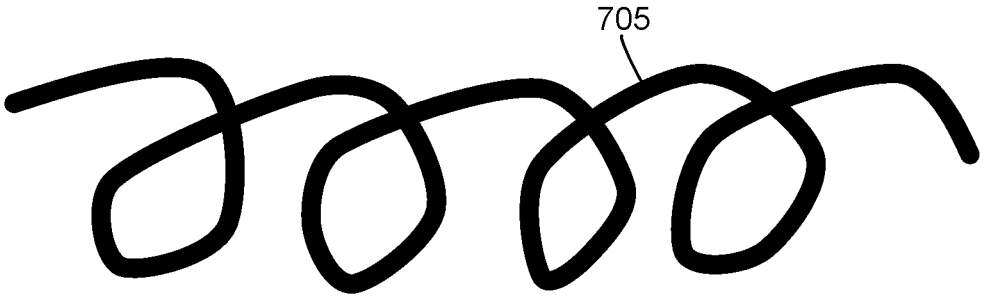
FIG. 11 illustrates a twisted example of a flexible light strip.

In some embodiments, the flexible light strip 602 is twisted as a spring. FIG. 11 shows a twisted form of a flexible light strip 705. In such case, in addition to be bent with the hooks, the flexible light strip 705 is twisted as a spring shape to increase flexibility and also to increase light spreading angles.

In some embodiments, the top hook are made of elastic metal material.

In FIG. 9, an antenna 707 is attached to the flexible light strip for transmitting a wireless signal to the driver.

In FIG. 9, the flexible light strip is easier to deform on the bending points 708, 709. For example, multiple LED modules 710, 711 are mounted on two sides of a flexible substrate 712, which may be made of transparent material. In some other case, the flexible substrate 712 may be made of non-transparent material, e.g. ceramic material.

In FIG. 8, the light bulb apparatus may also include bottom hooks 619 for fixing second bending points 620 of the flexible light strip 602.

In some embodiments, the multiple top hooks and the multiple bottom hooks are misaligned along the central bar.

Figure 7:
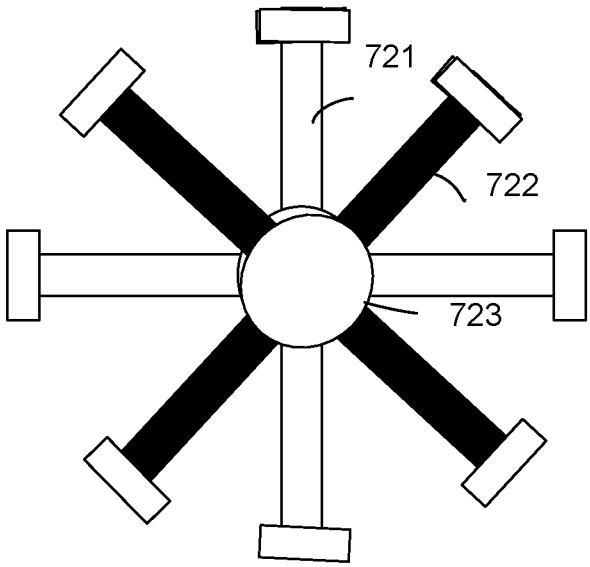
FIG. 7 illustrates a misalignment example of top hooks and bottom hooks.

FIG. 7 shows a top view for illustrating a misalignment of the top hooks 721, marked with white color, and bottom hooks 722, marked with black color.

In some embodiments, the multiple top hooks are fixed to a top ring 723 for the central bar 723 to insert.

In some embodiments, the second ends of the multiple top hooks are closed hook rings for inserting the flexible light strip.

In some embodiments, the top ring is placed to a bottom position of the central bar for inserting the flexible light strip before moving to a top position of the central bar.

In some embodiments, the central bar has a buckle structure 725 for fixing the top ring 723 to the top position of the central bar.

Figure 3:
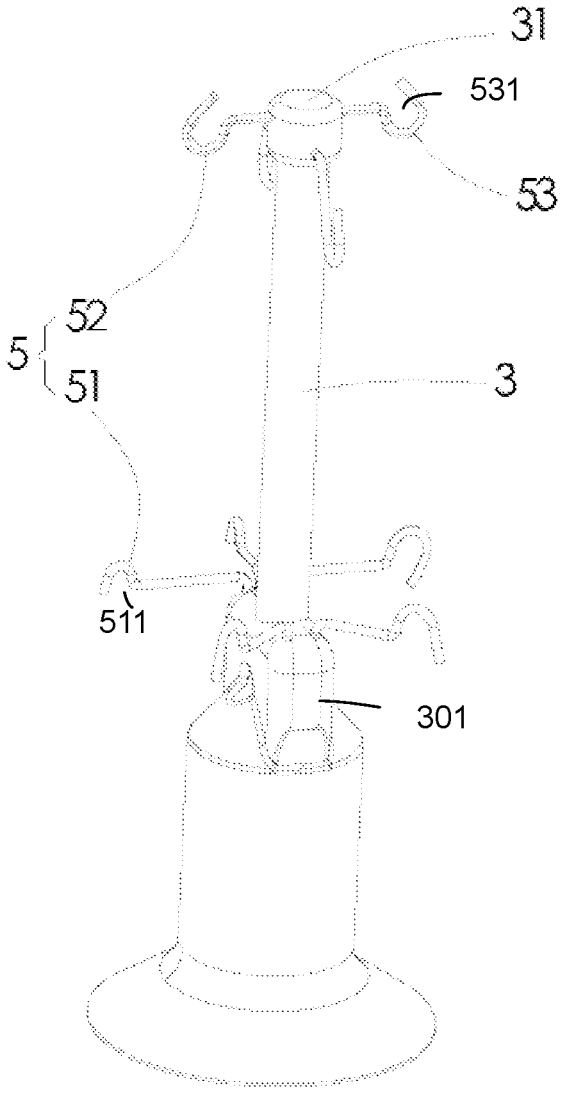
FIG. 3 illustrates a part of the component in FIG. 2.

In FIG. 3, the multiple top hooks 53 are fixed to a hat 31 for attaching to a top of the central bar 3.

In FIG. 3, the bottom hooks 51 are partly embedded in the central base 301.

In FIG. 3, the multiple top hooks have top hook openings 531 for inserting the first bending points of the flexible light strip.

The multiple bottom hooks 51 have bottom hook openings 511 for inserting the second bending points of the flexible light strip.

Figure 5:
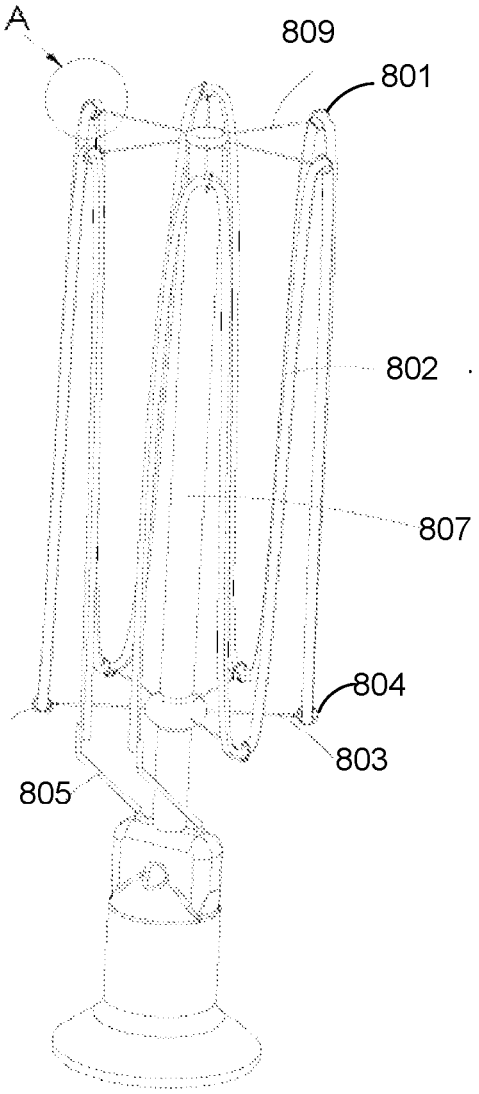
FIG. 5 illustrates a component in the example of FIG. 4.

In FIG. 5, some bottom hooks 51 are fixed to the central bar 3.

The top openings 531 and the bottom openings 511 face to opposite directions.

In FIG. 8, the central base is mounted with an auxiliary light source 651 to emit a second light. With the auxiliary light source 651, e.g. a light source plate mounted with LED modules, sufficient illumination is provided even the flexible light strip emits less light for decoration purpose. Sometimes, the flexible light strip may appear uncomfortable for eyes. Users may choose different working modes to select only turning on the auxiliary light source 651.

In FIG. 9, the flexible light strip are mounted with multiple LED modules 710, 711 on two sides of a substrate 712.

Figure 10A:
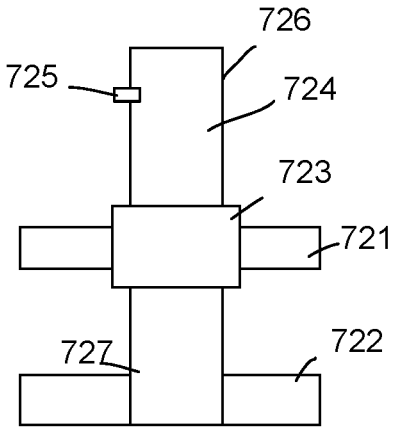
FIG. 10A illustrates a first status during assembly.
Figure 10B:
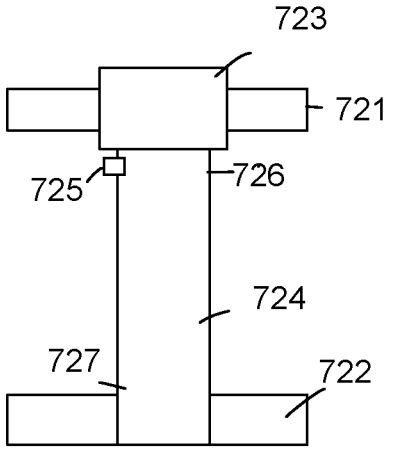
FIG. 10B illustrates a second status during assembly.

Please refer to FIG. 7, FIG. 10A and FIG. 10B. The top hooks 721 are attached to a top ring 723 which may be moved along the central bar 724. The top ring 723 is moved to the bottom position 727 when attaching the flexible light strip during assembly.

When the flexible light strip is attached to the top hooks 721 and the bottom hooks 722, the top ring 723 is moved upward to the top position 726, where the central bar 724 has a buckle structure 725 for fixing the top ring 723 to the top position 726.

Figure 1:
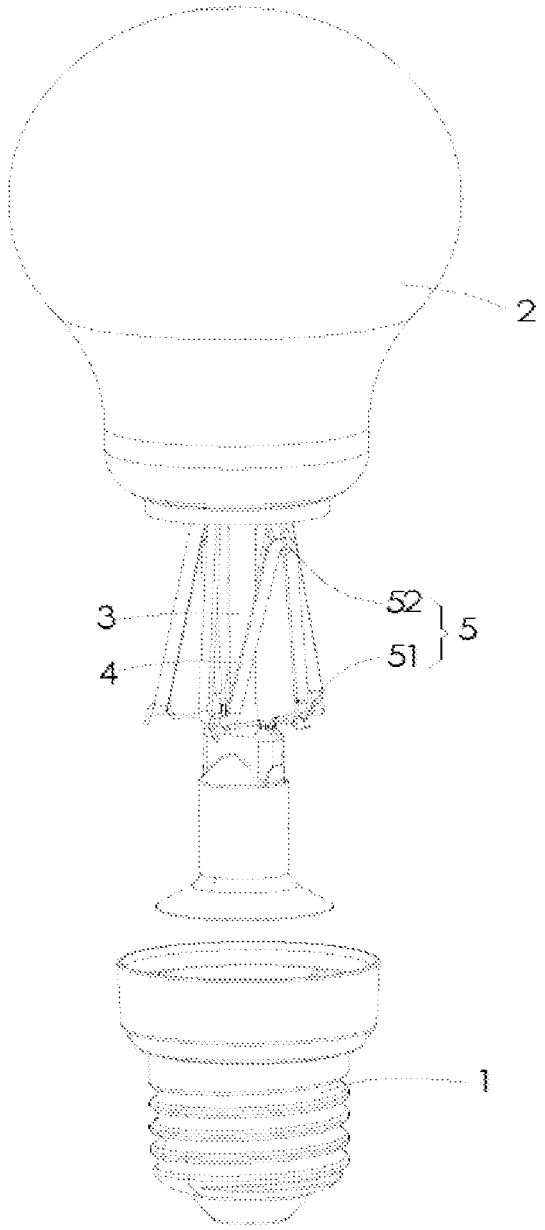
FIG. 1 illustrates an exploded view of a light bulb embodiment.

Please refer to FIG. 1. In FIG. 1, a light bulb apparatus includes a bulb shell 2 and an Edison cap 1. The light bulb apparatus includes a central bar 3, a flexible light strip 4 and a bracket with multiple top hooks 52 and bottom hooks 51.

Figure 2:
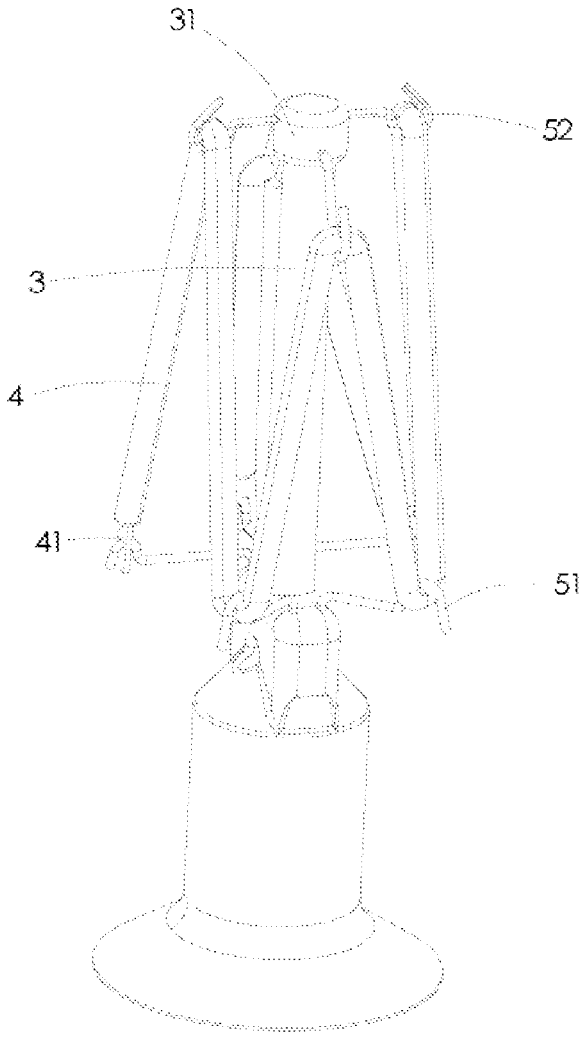
FIG. 2 illustrates a component in the example of FIG. 1.

Please refer to FIG. 2. In FIG. 2, the flexible light strip 4 has two end electrodes 41 connecting to first electrodes of wires connecting to a driver. The top hooks 52 are fixed to a hat 31 mounted on top of the central bar 3.

FIG. 3 shows another view of the bracket. The same reference numerals among different drawings refer to the same components and may not be described again for brevity.

Figure 4:
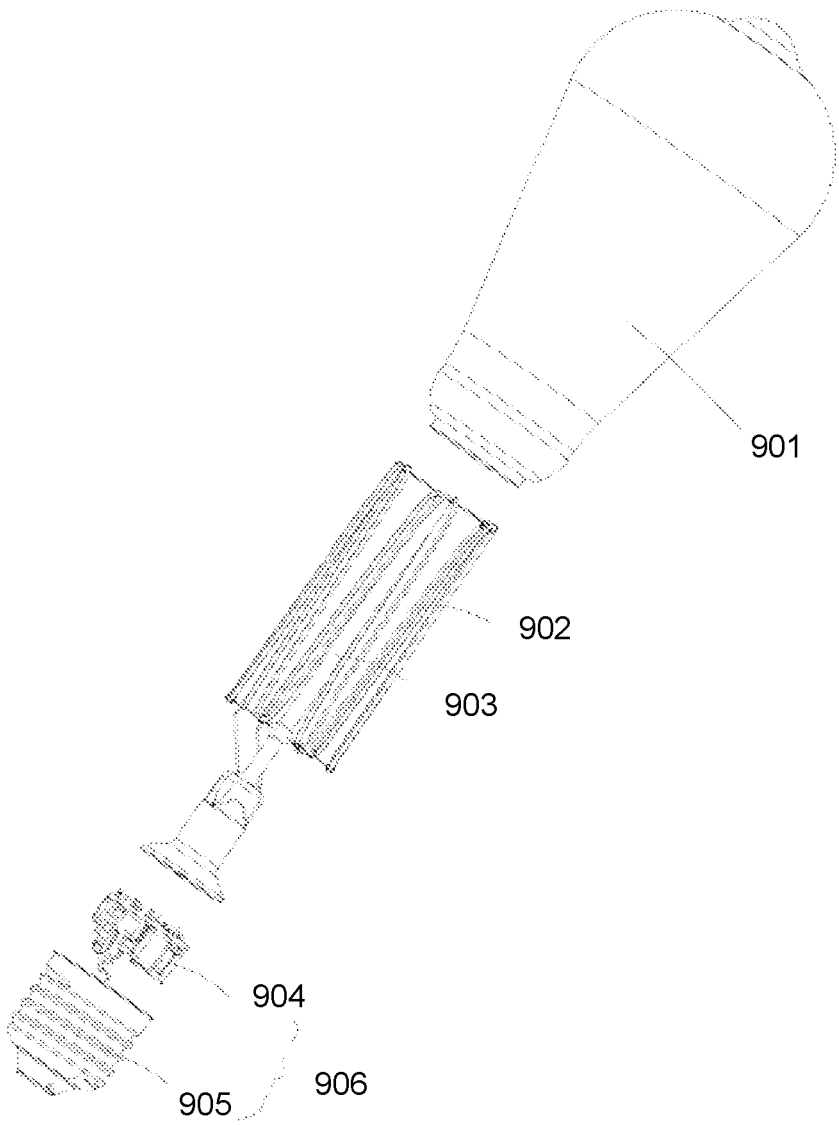
FIG. 4 illustrates an exploded view of another light bulb embodiment.

FIG. 4 shows another light bulb apparatus. In FIG. 4, the light bulb apparatus has a bulb shell 901, a flexible light strip 902 and a bracket 903. There is a driver 904 placed in an Edison cap 905 forming a driving part 906.

FIG. 5 shows a module inside the example of FIG. 4.

A central bar 807 is attached with top hooks 809. In such example, the top hooks has a hook ring 801 for inserting the flexible light strip 802. The bottom hook 803 also has an opening for inserting the flexible light strip 803. The electrodes 805 are connected to a driver for receiving a driving current.

Figure 6:
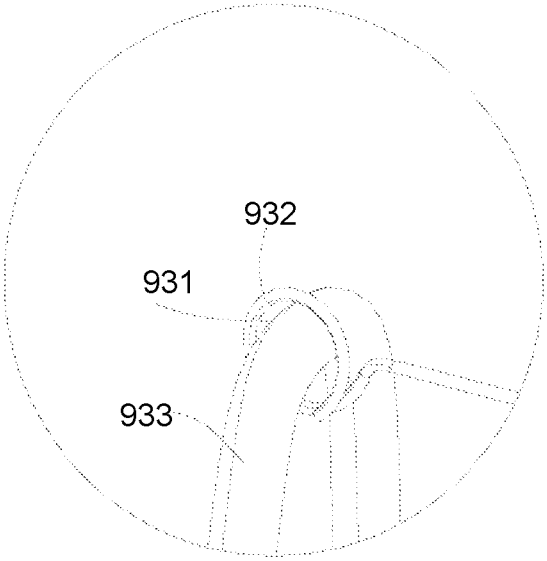
FIG. 6 illustrates a zoom-up view of a hook ring.

FIG. 6 shows a zoom-up view of the hook opening 932 defining a through hole 931 for inserting the flexible light strip 933.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A light bulb apparatus, comprising:

a bracket comprising a central bar and multiple top hooks, wherein the multiple top hooks have first ends connected to the central bar;

a flexible light strip with multiple first bending points fixed to second ends of the multiple top hooks for expanding the flexible light strip;

a bulb shell;

a driver for converting an external power source to a driving current; and a central base, wherein the central base encloses a part of two wires, wherein the central base exposes first electrodes of the two wires for connecting to the flexible light strip, wherein the central base exposes second electrodes of the two wires for receiving the driving current, wherein the central base and the bulb shell form a closed space for holding the flexible light strip and the bracket, wherein the first electrodes each has a hook structure with a bent part, wherein the flexible light strip has end electrodes on two opposite ends, wherein the end electrodes each has a hole for the bent part of the hook structure to insert to form an electric connection, wherein the multiple top hooks are fixed to a top ring for the central bar to insert, wherein the second ends of the multiple top hooks are closed hook rings for inserting the flexible light strip, wherein the top ring is placed to a bottom position of the central bar for inserting the flexible light strip before moving to a top position of the central bar.

2. The light bulb apparatus of claim 1, wherein the central base is made of glass material.

3. The light bulb apparatus of claim 2, wherein a heat dissipation gas is filled in the closed space via the central base.

4. The light bulb apparatus of claim 2, wherein the central bar is made of glass material.

5. The light bulb apparatus of claim 1, wherein the flexible light strip is twisted as a spring.

6. The light bulb apparatus of claim 1, wherein the top hook are made of elastic metal material.

7. The light bulb apparatus of claim 1, wherein an antenna is attached to the flexible light strip for transmitting a wireless signal to the driver.

8. The light bulb apparatus of claim 1, further comprising bottom hooks for fixing second bending points of the flexible light strip.

9. The light bulb apparatus of claim 8, wherein the multiple top hooks and the multiple bottom hooks are misaligned along the central bar.

10. The light bulb apparatus of claim 8, wherein the multiple top hooks are fixed to a hat for attaching to a top of the central bar.

11. The light bulb apparatus of claim 8, wherein the bottom hooks are partly embedded in the central base.

12. The light bulb apparatus of claim 8, wherein the multiple top hooks have top hook openings for inserting the first bending points of the flexible light strip, wherein the multiple bottom hooks have bottom hook openings for inserting the second bending points of the flexible light strip, wherein the top openings and the bottom openings face to opposite directions.

13. The light bulb apparatus of claim 1, wherein the central base is mounted with an auxiliary light source to emit a second light.

14. The light bulb apparatus of claim 1, wherein the flexible light strip are mounted with multiple LED modules on two sides of a substrate.

* * * * *